US005199598A

United States Patent [19]

Sampson

[11] Patent Number: 5,199,598

[45] Date of Patent: Apr. 6, 1993

[54] DISPENSING APPARATUS FOR TENNIS BALL CONTAINERS

[76] Inventor: Tyree Sampson, 3509 Camelot Rd., Trotwood, Ohio 45426

[21] Appl. No.: 763,628

[22] Filed: Sep. 23, 1991

[51] Int. Cl.[5] ..... G07F 11/00

[52] U.S. Cl. ..... 221/194; 221/298; 221/299; 221/301

[58] Field of Search ..... 221/191, 194, 281, 289, 221/297, 298, 299, 301; 312/45, 72, 73

[56] References Cited

U.S. PATENT DOCUMENTS

| | | | |
|---|---|---|---|
| 2,382,191 | 8/1945 | Weichselbaum | 312/45 |
| 2,711,321 | 6/1955 | McGraw, Sr. | 221/298 X |
| 2,901,118 | 8/1959 | Beesley . | |
| 3,175,669 | 3/1965 | Garvin . | |
| 3,322,303 | 5/1967 | Grindinger et al. | 221/298 |
| 3,348,733 | 10/1967 | Johnson | 221/298 |
| 3,613,945 | 10/1971 | Rockola et al. | 221/295 |
| 3,776,417 | 12/1973 | Austin | 221/312 R X |
| 3,946,847 | 3/1976 | Bock | 221/93 |
| 4,190,179 | 2/1980 | Moss et al. | 221/299 |
| 4,498,569 | 2/1985 | Tanaka et al. | 193/27 |
| 4,685,590 | 8/1987 | Negishi et al. | 221/241 |
| 4,735,344 | 4/1988 | Wuethrich | 221/194 |

*Primary Examiner*—David H. Bollinger
*Attorney, Agent, or Firm*—Killworth, Gottman, Hagan & Schaeff

[57] ABSTRACT

An apparatus for dispensing tennis balls is provided having a hopper for storing tennis ball containers, a serpentine track, and a dispensing device for releasing tennis ball containers from the serpentine track. A housing of moderate size supports the various components of the apparatus, and preferably includes a money operated actuator to actuate the dispensing device, and a dispensing bin in a removable front housing panel. The apparatus may be mounted on a stand and used as a free standing unit, or placed on a counter.

12 Claims, 8 Drawing Sheets

98
94
108
102
102
100
110B
10
110A
106
106
104
20
88
102
22
22

DISPENSING APPARATUS FOR TENNIS BALL CONTAINERS

BACKGROUND OF THE INVENTION

The present invention relates to an apparatus for automatically dispensing tennis balls, and in particular, to a vending machine for dispensing cans of tennis balls.

Presently it is a common practice for employees of tennis facilities to sell tennis balls directly to patrons. However, this practice is inefficient and inconvenient for patrons, particularly in busy facilities, where the wait to obtain tennis balls may be long. Similarly, consumers who play tennis on remote public tennis courts typically have to purchase tennis balls at locations other than the tennis court sites. The practice of providing for the purchase of tennis balls at tennis facilities or at other locations for use at remote tennis courts is both time consuming and expensive for the tennis facilities, whose employees must provide such service to its patrons. As well, the practice of purchasing tennis balls at locations other than tennis court sites is time consuming and inconvenient for consumers.

Dispensing machines have been developed for a variety of articles, such as beverages and canned foods. Typically, such machines deliver articles along a generally serpentine track or chute to a dispensing space. For example, Beesley, U.S. Pat. No. 2,901,118, discloses a storing and dispensing apparatus having a serpentine chute along which containers of food are stored and fed by gravity to a dispensing space. The apparatus of Beesley includes a plurality of storage cells which are adjustable to accommodate different container sizes. Similarly, Negishi et al, U.S. Pat. No. 4,685,590, discloses a dispensing machine having a serpentine track interconnecting a loading space with a dispensing space, and having means for adjusting the track for different sized articles.

Other dispensing machines have been developed which store cylindrical or spherical objects in a hopper area, and deliver them to a dispensing space along a simple track. See, Garvin, U.S. Pat. No. 3,175,669 and Bock, U.S. Pat. No. 3,946,847. Several dispensing machine improvements have been directed to improved means for dispensing cylindrical objects one at a time to a dispensing space. For example, Rockola et al, U.S. Pat. No. 3,613,945, discloses a solenoid operated vend and feed gate, while Moss et al, U.S. Pat. No. 4,190,179 disclose an improved device employing a pair of spaced, rotatable disc-like structures which rotate in concert to release one cylindrical product at a time from a shelf or track.

A drawback of these dispensing machines, however, is that they are designed for canned goods which are relatively short in length. Although some machines are adjustable within a given range, they remain unsuitable for larger and longer cylindrical containers.

Accordingly, while dispensers have long been known for various articles such as canned foods and beverages, the need continues to exist for an economical means for storing and dispensing tennis balls which will provide quick, easy, and efficient sales to patrons of tennis facilities and remote public tennis court sites.

SUMMARY OF THE INVENTION

The present invention satisfies that need by providing an apparatus for dispensing tennis ball containers for use at sports and tennis facilities and tennis court sites. The apparatus includes a hopper for storage of numerous tennis ball containers, a serpentine track for further storage and transfer to an outlet, and a dispensing means for releasing the tennis ball containers one at a time from the track. The apparatus of the present invention further includes a housing enclosing the hopper, serpentine track and dispensing means.

The hopper of the present invention is designed for easy access for restocking. Further, both the hopper and the serpentine track are designed to promote organized discharge of tennis ball containers placed therein.

The serpentine track, also referred to simply as the track, includes two segments. The first segment tilts at a slight angle as it extends downward from the hopper. This slight angle prevents rapid shifting and jamming of tennis ball containers in the hopper as they enter the upper, first end of the track. The tennis ball containers move by force of gravity down the track. From the first segment they move through a turn and into a more steeply inclined second segment, where the tennis ball containers encounter the dispensing means adjacent to the outlet, second end of the track.

The dispensing means operates to dispense tennis ball containers, preferably, one at a time. In the dispensing means, a discharge lever and a stop lever operate in timed coordination between first and second positions to alternately interrupt the movement of tennis ball containers on the track, and release ones of the containers to a dispensing bin.

The housing of the present invention preferably includes a dispensing bin at the outlet, second end of the track, into which tennis ball containers are dispensed from the track, a consumer access door, and a bin gate to inhibit tampering. The housing also includes means for actuating the dispensing means which is operable by the insertion of money. Preferably, the front cover of the housing is mounted along one edge to swing open for front access to the hopper, track and dispensing means, and to permit servicing of the means for actuating. The overall size of the present invention is moderate, and the apparatus may be mounted on a stand, or placed on a counter or other supporting structure.

Once tennis ball containers are loaded into the hopper and track, operation of the present invention to dispense a tennis ball container begins by actuating the dispensing means with money. The stop lever then moves from its first position, where it allows free movement of tennis ball containers in the track, to its second position, where it interrupts the movement of one or more tennis ball containers to be retained in the track. Meanwhile, the discharge lever retracts from its first position, where it interrupts the movement of tennis ball containers to be dispensed, to its second position, where it allows a tennis ball container to be dispensed to exit from the track. Thereafter, the discharge lever returns to its first position to interrupt the movement of the next tennis ball container to be dispensed, and the stop lever returns to its first position, allowing the tennis ball containers to again freely move in the track. The tennis ball containers then advance and fill the space made available between the stop lever and discharge lever by the dispensed container. The tennis ball container preferably is released from the track into a dispensing bin, where the consumer may remove it for use.

DETAILED DESCRIPTION OF THE PREFERRED EMBODIMENT

Figure 1:
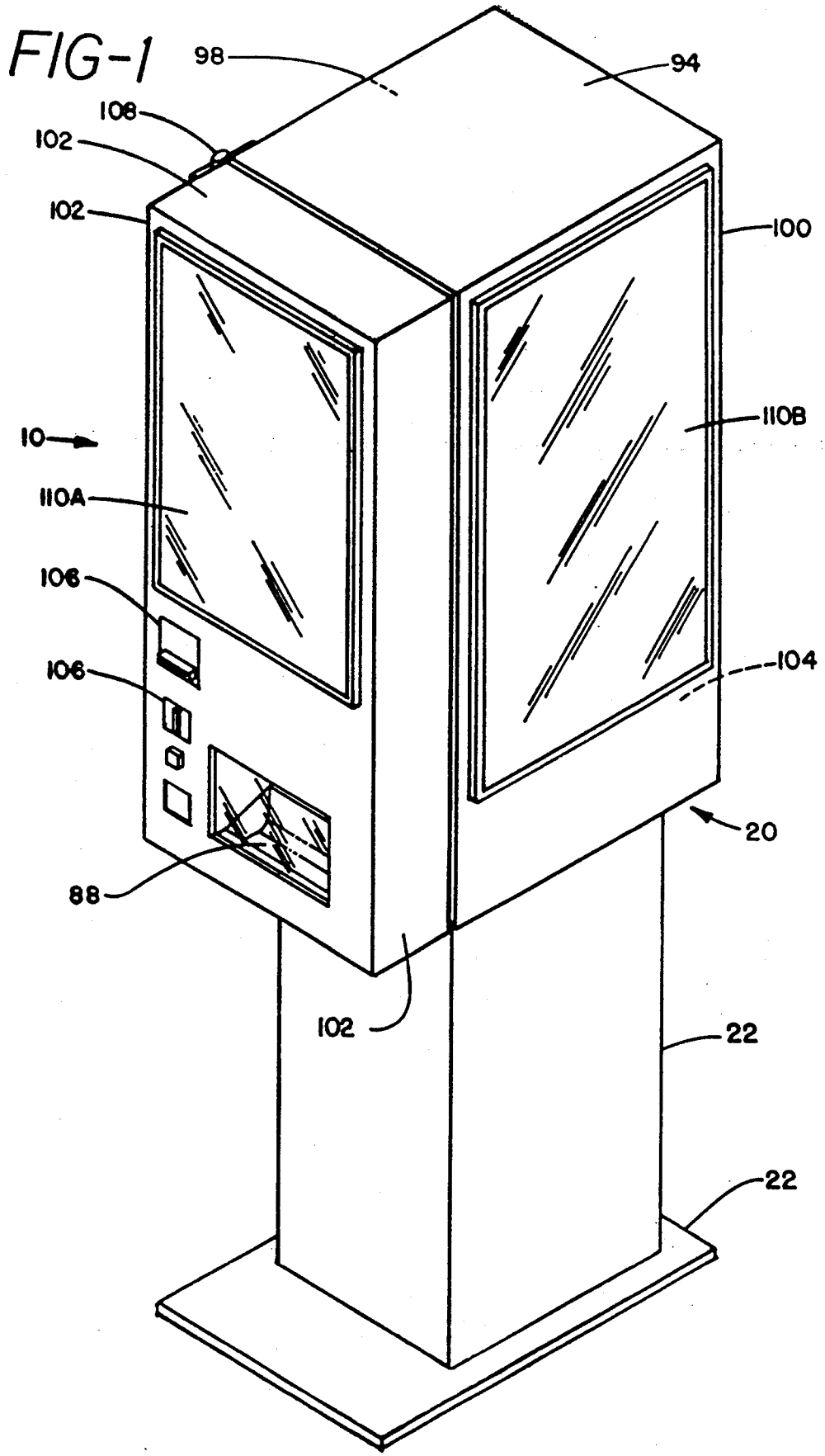
FIG. 1 is a schematic perspective view of the apparatus of the present invention in the preferred embodiment.
Figure 2:
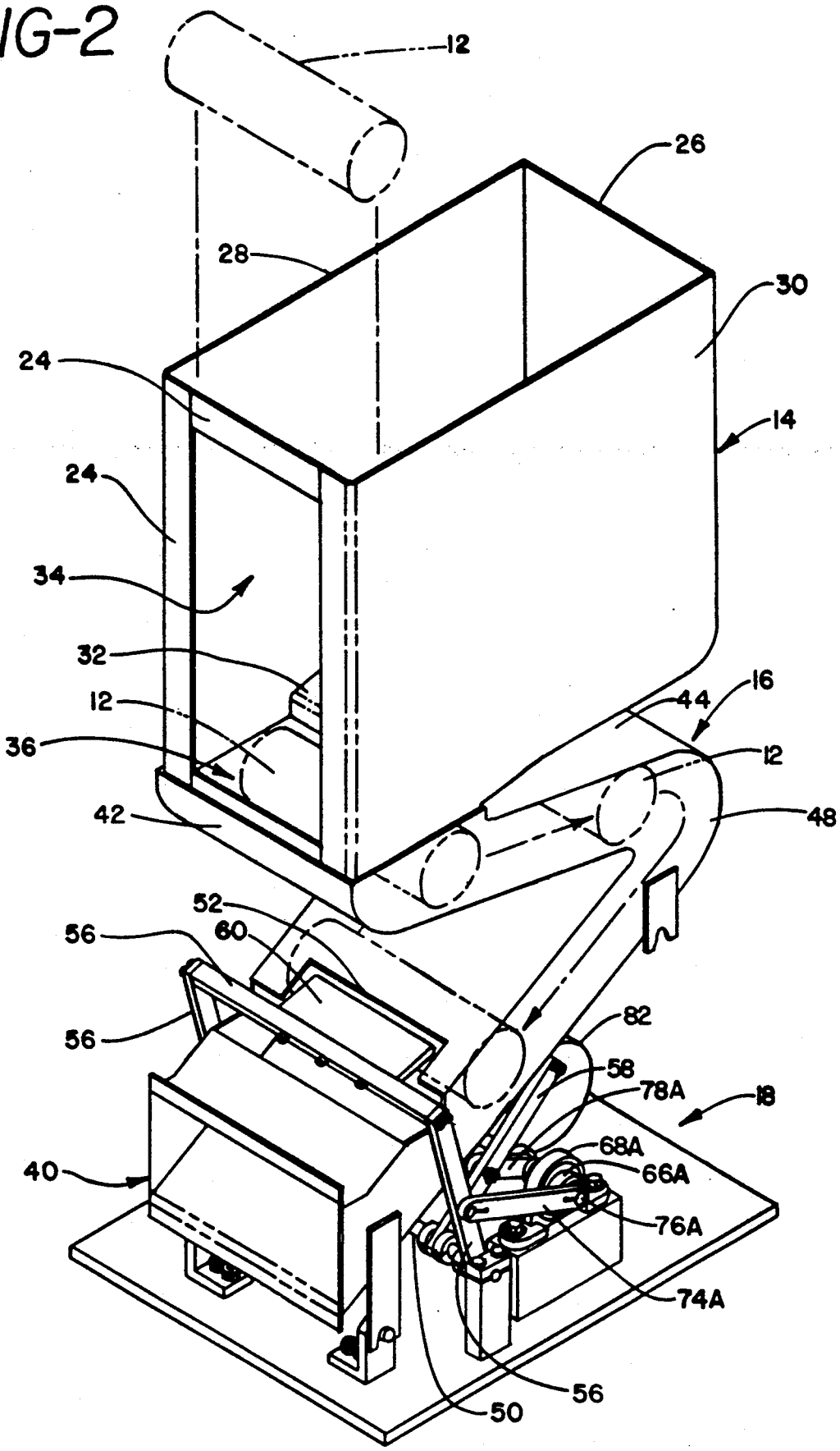
FIG. 2 is a schematic perspective view of the apparatus of the present invention with the housing removed.

Referring to FIGS. 1 and 2, in accordance with the present invention, apparatus 10 for dispensing tennis ball containers 12 is provided for use at sports and tennis facilities. As shown in FIG. 2, the apparatus 10 includes a hopper 14 for storage of numerous tennis ball containers 12 shown in phantom, a serpentine track 16 providing further storage as well as conveyance to an outlet, and a dispensing means 18 for releasing the tennis ball containers 12 one at a time from the track 16. As shown in FIG. 1, the apparatus 10 includes a housing 20 and is preferably mounted on a stand 22.

Figure 3:
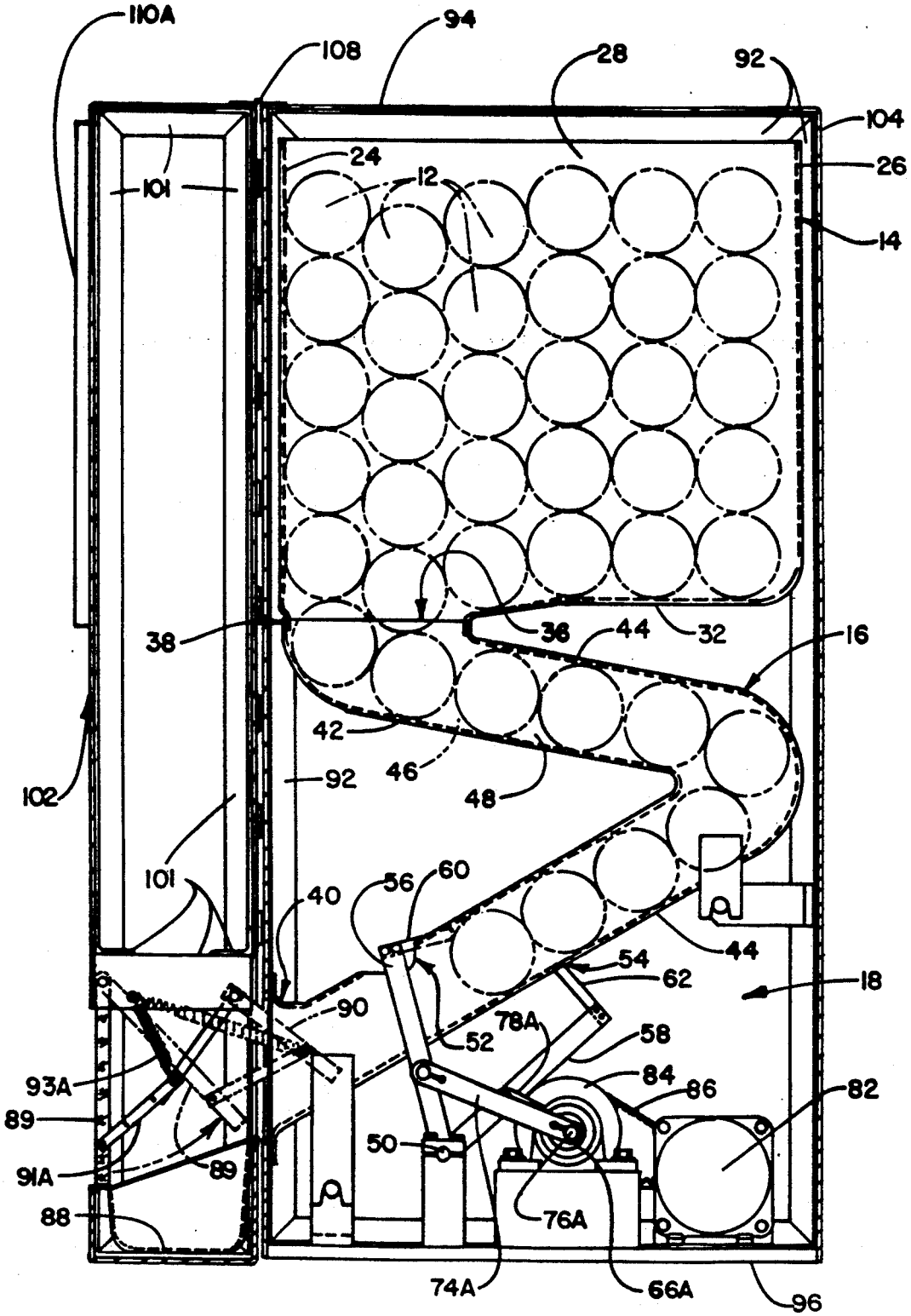
FIG. 3 is a side elevational view of the apparatus of the present invention with the right side panel of the housing removed.

With reference to FIG. 2, the hopper 14 preferably has a generally rectangular shape defined by a front panel 24, back panel 26, opposing side panels 28, 30 and a bottom panel 32. A top panel (not shown) is not necessary, although one may be provided. Front panel 24 preferably includes a first aperture 34 through which tennis ball containers 12 may be passed to stock the hopper 14. The width of first aperture 34 is less than the length of a tennis ball container 12 while its height, at minimum, must be sufficient to permit manipulation of tennis ball containers 12 therethrough. Preferably, first aperture 34 extends substantially down the length of the front panel 24, as shown in FIG. 2, to facilitate restocking. However, first aperture 34 could be placed in back panel 26, or one of side panels 28, 30 for restocking hopper 14. Alternatively, first aperture 34 could be eliminated completely and restocking accomplished through the top of hopper 14. Referring now to FIG. 3, the bottom panel 32 preferably includes a second aperture 36 through which tennis ball containers 12 pass into track 16. At least a portion of bottom panel 32 is slightly inclined to urge tennis ball containers 12 therein towards second aperture 36. The hopper 14 is designed to store sufficient tennis ball containers 12 so that restocking need take place only at reasonable intervals. Preferably, hopper 14 has a depth of six tennis ball container diameters, and a height of five tennis ball containers, as shown in FIG. 3.

As shown in FIGS. 2 and 3, track 16 extends from an upper, first end 38 where tennis ball containers enter from second aperture 36, to an outlet, second end 40, where tennis ball containers 12 are discharged. Track 16, defined by opposing, generally parallel first and second walls 42, 44 and side walls 46, 48, is designed to tilt at a slight angle as it extends downward from the hopper 14, preferably about 10 degrees from horizontal. This slight angle prevents rapid shifting of tennis ball containers 12 in the hopper 14 and related jamming, as the tennis ball containers 12 enter the upper, first end 38 of the track 16. The tennis ball containers 12 move by force of gravity down the track 16, through a turn, and into a segment more steeply inclined, preferably at substantially 30 degrees. The tennis ball containers 12 continue therethrough whereupon they encounter the dispensing means 18 adjacent to the second end 40 of the track 16. As shown in FIGS. 2–5, track 16 further includes first and second slots 52, 54 in first and second walls 42, 44, respectively.

The dispensing means 18 operates to dispense tennis ball containers 12 one at a time from the second end 40 of track 16. Referring to FIGS. 2–7, dispensing means 18 includes a discharge lever 56 and a stop lever 58 which operate in timed coordination between first and second positions to alternately interrupt the movement of tennis ball containers 12 in the track 16.

Figure 4:
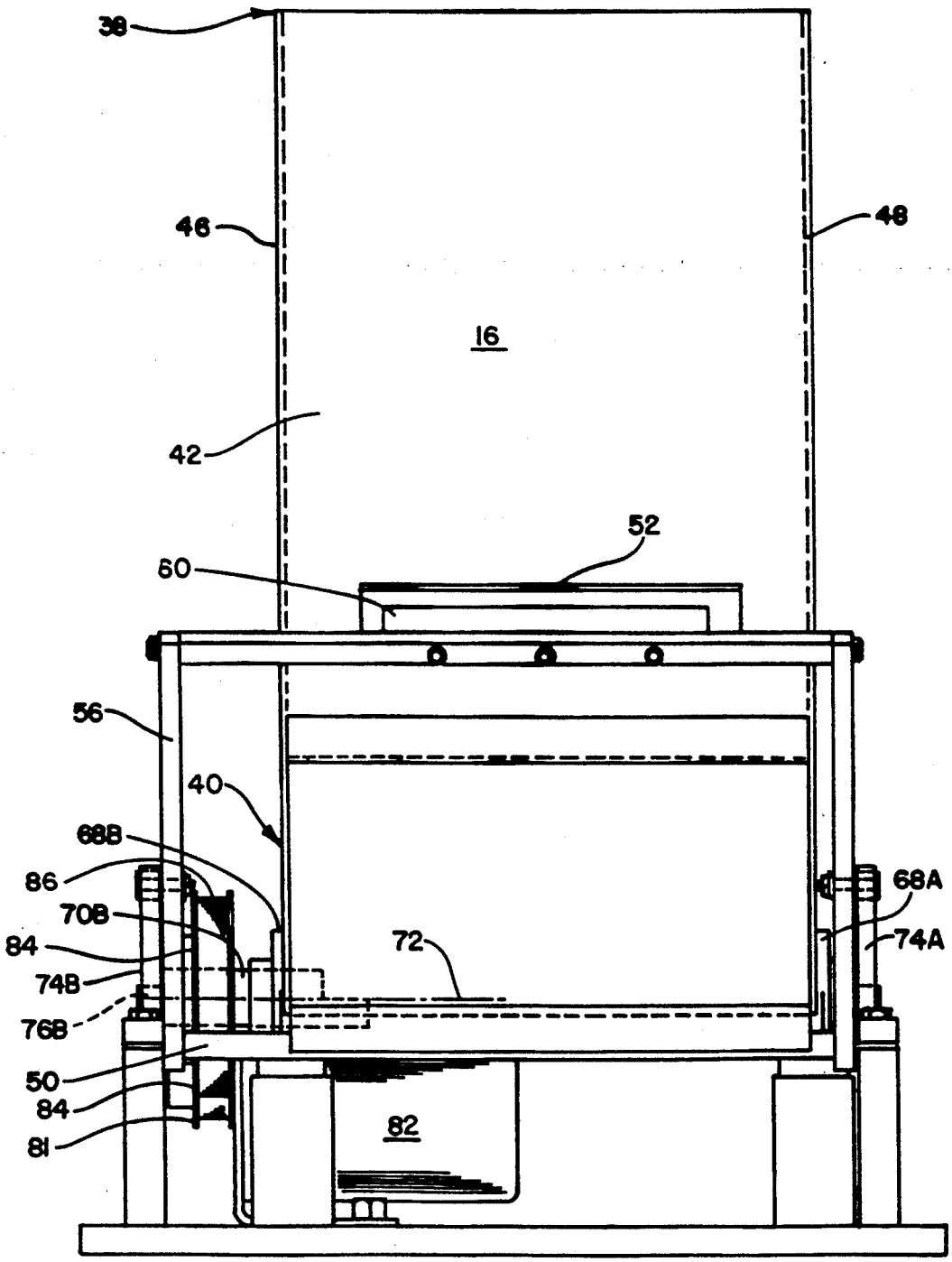
FIG. 4 is a partial front elevational view of the apparatus of the present invention with the housing removed to show the track and means for discharging tennis ball containers.
Figure 6:
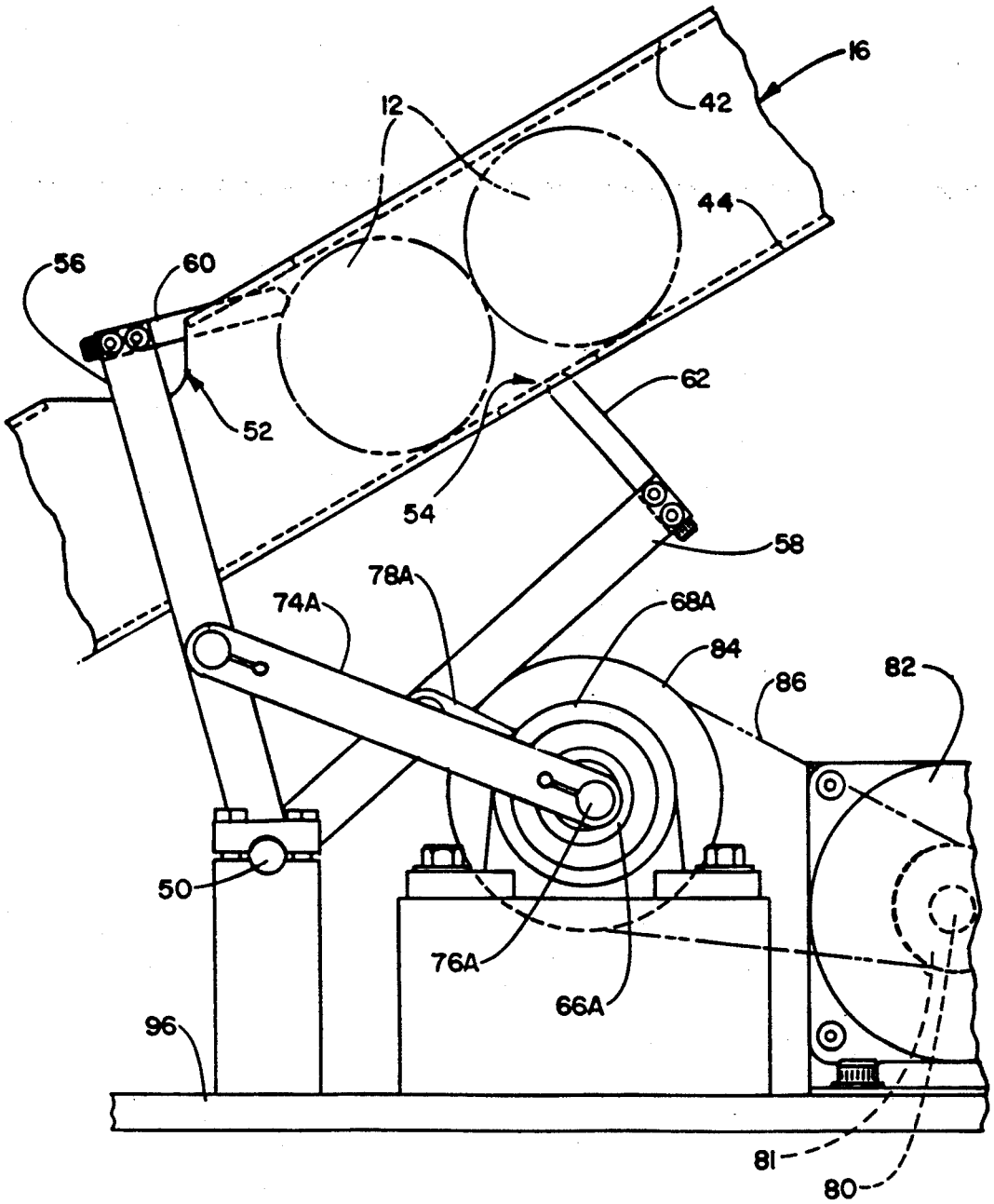
FIG. 6 is a detail side elevational view of the dispensing means of the present invention with the discharge lever and stop lever in their first positions.
Figure 7:
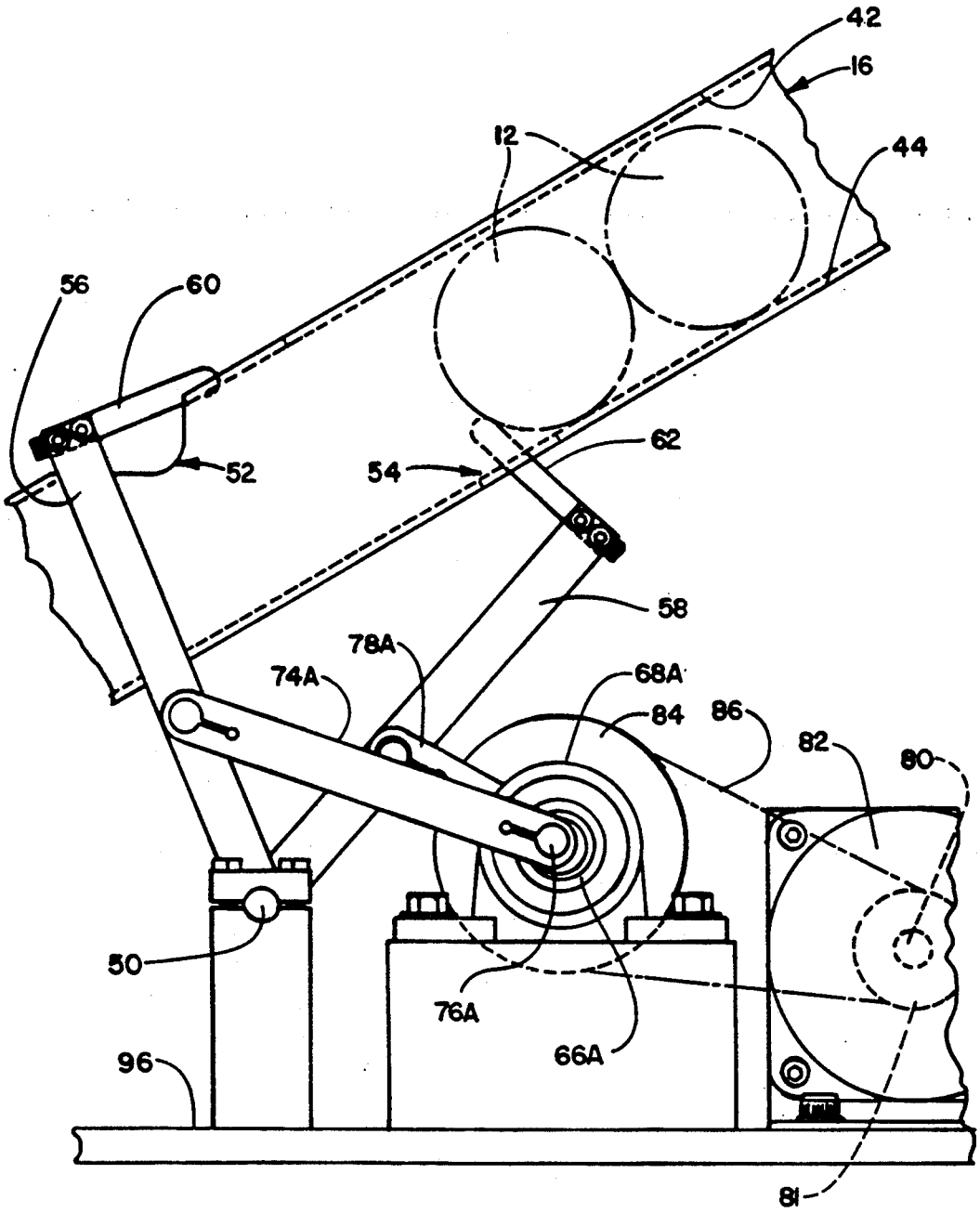
FIG. 7 is a detail side elevational view of the dispensing means of the present invention with the discharge lever and stop lever in their second positions.

As best shown in FIG. 4, discharge lever 56 is generally U-shaped, and is inverted so that the opposite ends thereof may be rotatably attached to a first, preferably fixed, shaft 50. As shown in FIGS. 3 and 4, discharge lever 56 includes a discharge plate 60 which is attached generally between the opposite ends of the discharge lever 56, and which extends laterally from the discharge lever 56, as seen in FIG. 3. Discharge lever 56 is rotatable between a first and second positions to extend or retract the discharge plate 60 through the first slot 52 into and out of the path of the tennis ball containers 12. FIG. 6 shows discharge lever 56 in its first position, with discharge plate 60 interrupting the path of tennis ball containers 12 and restraining a tennis ball container 12 which is to be next dispensed. FIG. 7 shows discharge lever 56 in a second position, with discharge plate 60 retracted, allowing the tennis ball container 12 previously restrained to be dispensed.

Figure 5:
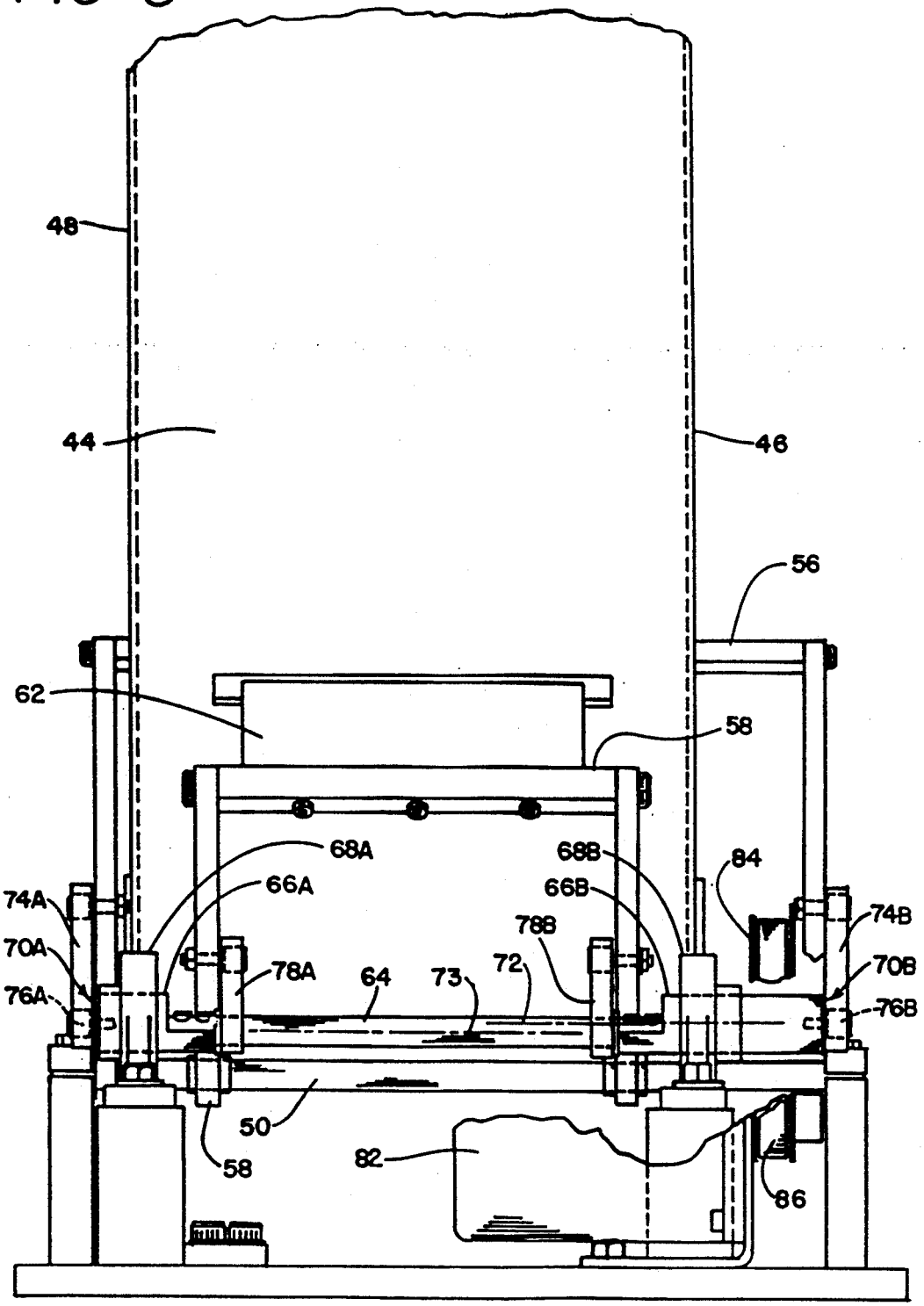
FIG. 5 is a partial rear elevational view of the apparatus of the present invention with the housing removed to show the track, and the motor cut away to show the arrangement of the first and second eccentric stub shafts, first and second shafts, and the means for discharging tennis ball containers.

As best shown in FIG. 5, stop lever 58 is also generally U-shaped, and is inverted so that the opposite ends thereof may be rotatably attached to the first shaft 50. As shown in FIGS. 3 and 5, stop lever 58 includes a stop plate 62 which is attached generally between the opposite ends of the stop lever 58, and which extends laterally from the stop lever 58, as seen in FIG. 3. Stop lever 58 is rotatable between first and second positions to extend or retract the stop plate 62 through the second slot 54 into and out of the path of the tennis ball containers 12. FIG. 6 shows stop lever 58 in its first position, with stop plate 60 retracted from the path of tennis ball containers 12. FIG. 7 shows stop lever 58 in a second position, with stop plate 62 extended into the path of tennis ball containers 12 to restrain a tennis ball container 12 which is to be next dispensed, allowing the preceding tennis ball container 12 to be dispensed.

The dispensing means 18 further includes means for reciprocating discharge lever 56 and stop lever 58 in a cycle between their respective first and second positions, in timed relation, so that they alternately interrupt the movement of the tennis ball containers 12 in the track 16, and at least one of them controls the movement of the tennis ball containers 12 at all times. The means for reciprocating may also be referred to as means for swinging.

The means for reciprocating is variously shown in FIGS. 2–7. Referring to FIG. 5, the means for reciprocating includes first and second eccentric stub shafts 66*a*, 66*b*, respectively, rotatably mounted in first and second bearings 68*a*, 68*b*, respectively, for rotation about an axis of rotation 72. The ends of second shaft 64 are attached to first and second eccentric stub shafts 66*a*, 66*b* so that second shaft 64 rotates eccentrically in housing 20 (not shown). Such eccentric rotation is produced by mounting the central axis 73 of second shaft 64 off-set from the axis of rotation 72. Second shaft 64 and first and second eccentric stub shafts 66*a*, 66*b* may, alternatively, be made as one piece. First and second eccentric stub shafts 66*a*, 66*b* include first and second end faces 70*a*, 70*b*, respectively, facing outward. Shown in FIGS. 2–3 and 5–7, means for reciprocating further includes a pair of first lever arms 74*a*, 74*b* extending from opposite sides of the discharge lever 56 to the first and second eccentric stub shafts 66*a*, 66*b*, respectively. One end of each of the first and second lever arms 74*a*, 74*b* is rotatably connected to the discharge lever 56, for example by bolt, pins or cam followers, while the opposite end of each is similarly connected to first and second end faces 70*a*, 70*b* of eccentric stub shafts 66*a*, 66*b*. Lever arms 74*a*, 74*b* are connected off-set from the axis of rotation of eccentric stub shafts 66*a*, 66*b*, preferably by first and second cam followers 76*a*, 76*b*, respectively. As first and second eccentric stub shafts 66*a*, 66*b* rotate, lever arms 74*a*, 74*b* thereby cause discharge lever 56 to reciprocate. Similarly, the means for reciprocating further includes a pair of second lever arms 78*a*, 78*b* extending from opposite sides of the stop lever 58 to shaft 64. Shaft 64 extends through the second lever arms, and preferably through bushings therein, to permit rotation of shaft 64. Thus, as shaft 64 rotates through an eccentric path, lever arms 78*a*, 78*b* cause stop lever 58 to reciprocate. First and second lever arms 74*a*, 74*b*, and 78*a*, 78*b*, are thus moved through respective reciprocating paths to provide coordinated action of discharge lever 56 and stop lever 58 and produce the results here indicated. The cam followers and bushings are made in a manner known in the art.

The means for reciprocating further includes a drive means for rotating the first and second eccentric stub shafts 66*a*, 66*b*, and second shaft 64. Referring to FIGS. 5–7, the drive means includes an electric stepper motor 82 adapted to provide a source of rotary power, such as motor drive shaft 80 having a motor drive pulley 81, a pulley 84 attached to the second eccentric stub shaft 66*b*, and a drive belt 86 connecting the source of rotary power at motor 82, i.e. drive shaft 81 via motor drive pulley 81, to the pulley 84.

The drive means of the present invention may be actuated by various means for actuating, to rotate the first and second eccentric drive shafts 66*a*, 66*b*, and second shaft 64 through a revolution, and to thereby cycle the discharge lever 56 and stop lever 58 through their first and second positions to dispense a tennis ball container 12. Such means for actuating, shown representatively in part in FIG. 1, preferably includes a money actuated control circuit 106, as known in the art, which may be actuated by coins or bills to generate a control signal to actuate motor 82.

Figure 8:
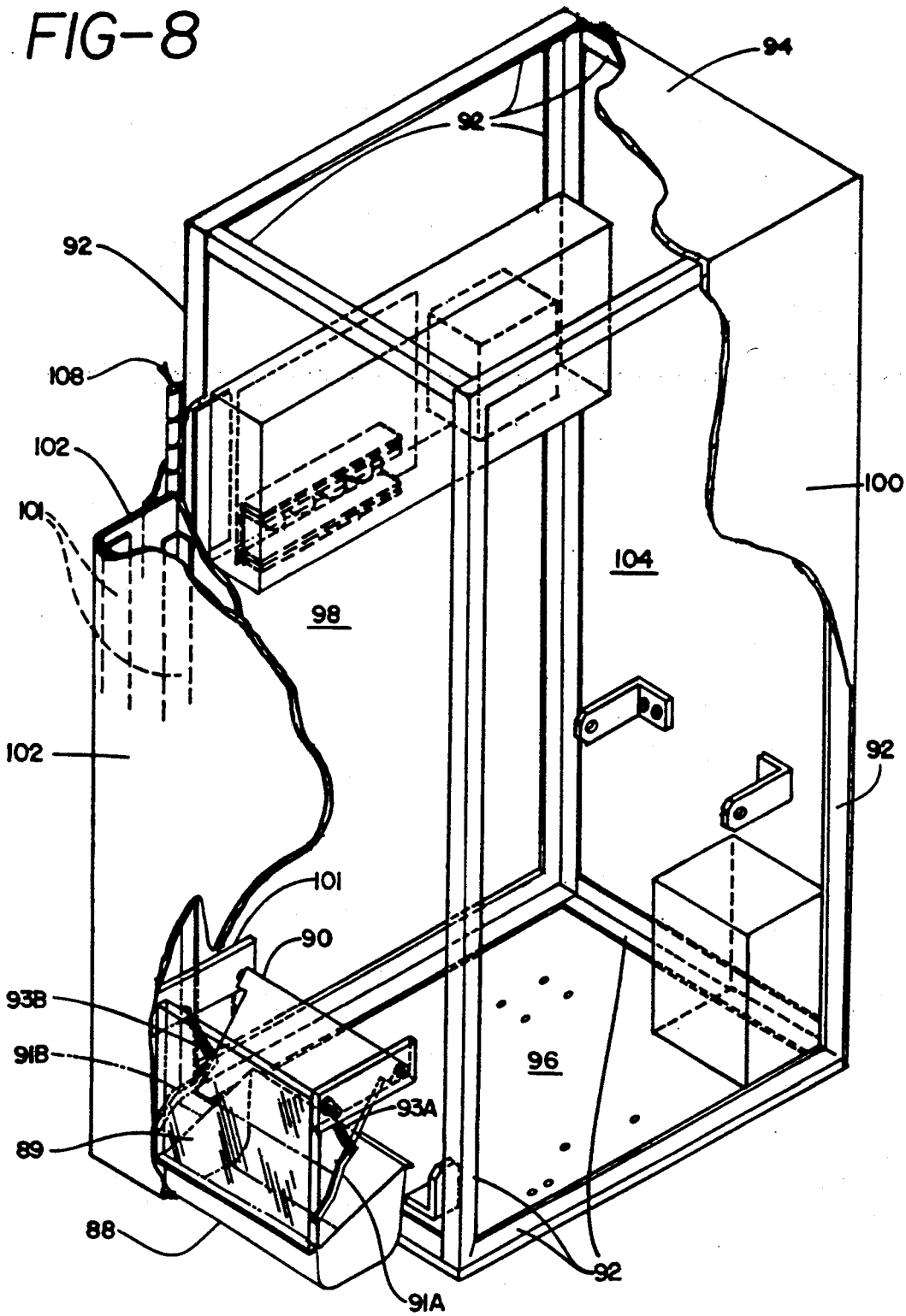
FIG. 8 is a schematic perspective view of the housing structure.

Referring to FIGS. 1, 3 and 8, the present invention further includes a dispensing bin 88, located adjacent to the second end 40 of the track 16, to receive tennis ball containers 12 dispensed from track 16. A gate means for closing the second end of the track 16 is further provided above dispensing bin 88. The gate means comprises a bin gate 90 rotatably mounted to swing along one edge in housing 20, and a consumer access door 89 mounted to swing inward to allow access to dispensing bin 88. Bin gate 90 is connected at its opposite side edges to consumer access door 89 by first and second link arms 91*a*, 91*b*. As shown best in FIG. 3, in its normal or "at rest" position, bin gate 90 is positioned upward and access door 89 maintained closed by first and second bias springs 93*a*, 93*b*. So positioned, bin gate 90 allows a tennis ball container 12 to pass unimpeded into dispensing bin 88. As shown in phantom in FIG. 3, when access door 89 is swung inward to remove a tennis ball container 12 dispensed into dispensing bin 88, bin gate 90 simultaneously swings downward and blocks the outlet, second end 40 of track 16 to inhibit tampering.

Housing 20 encloses and supports the various components of the present invention. As indicated generally in FIG. 8, housing 20 includes support frame 92, top housing panel 94, bottom housing panel 96, side housing panels 98, 100, front housing panel support frame 101, front housing panel 102 and rear housing panel 104. As noted above, dispensing bin 88, access door 89, and bin gate 90 are preferably supported by housing 20, and more specifically, by front housing panel support frame 101. At least a portion of the money operated control circuit 106 is also disposed in front housing panel 102, and supported by front housing panel support frame 101. Front housing panel 102 is supported on front housing panel support frame, and is preferably removable by swinging out and away by means of a hinge 108. Hinge 108 connects one edge of front housing panel 102 and front housing panel support frame 101 to support frame 92 supporting the remainder of housing 20, and is sufficiently strong to support the components disposed in front housing panel 102. Front housing panel 102 may thereby be used to provide access to restock hopper 14 through first aperture 34 with tennis ball containers 12, to collect money from and maintain the money operated control circuit 106, as well as to maintain the dispensing means 18 and other related components. A key lock (not shown) of a type known in the art may be used to lock the front panel 102 to the remainder of housing 20 and secure the contents of apparatus 10. The top, side, and rear housing panels, 94, 98 and 100, and 104, respectively, are also preferably secured by removable fasteners (not shown) to permit access, as needed, to components of the apparatus 10 of the present invention.

As further shown in FIG. 1, a removable advertisement panel 110 may be provided on the front, rear, or side housing panels 102, 104, 98, 100, such as a plastic, cardboard, or other rigid or semi-rigid panel material, retained by conventional means, such as tabs and slots, removable connectors, frames, and the like. Such advertisement panels 110 are preferably removable only from the inside of housing 20. By way of illustration, a front advertisement panel 110*a*, covering half of the front housing panel 102, and a side advertisement 110*b*, covering most of side housing panel 100, are shown. Smaller or larger, and multiple advertising panels, may be variously placed on housing 20.

In operation, insertion of money into the means for actuating actuates electric motor 82 of the drive means to begin the cycle for dispensing of a tennis ball container 12. As motor 82 begins to cycle through one revolution, the stop lever 58 moves from its first position, where it allows free movement of tennis ball containers 12 in the track 16, to its second position, where it interrupts the movement of one or more tennis ball containers 12 to be retained in the track 16. Meanwhile, the discharge lever 56 retracts from its first position, where it interrupts the movement of tennis ball container 12 to be dispensed to its second position, where it allows the tennis ball container 12 to be dispensed to exit from the track 16. At least one of the discharge lever 56 or stop lever 58 is interrupting the path of tennis ball containers 12 at all times. After a tennis ball container 12 exits from the track 16, the discharge lever 56 returns to its first position to interrupt the movement of the next tennis ball container 12 to be dispensed, and the stop lever 58 returns to its first position, allowing the tennis ball containers 12 to again freely move in the track 16.

While certain representative embodiments and details have been shown for purposes of illustrating the invention, it will be apparent to those skilled in the art that various changes in the apparatus disclosed herein may be made without departing from the scope of the invention, which is defined in the appended claims. For example, the dispensing means 18 may be arranged so that discharge lever 56 and stop lever 58 provide for two or more tennis ball containers 12 to be dispensed from track 16. By way of further example, other housing panels may be hinged for improved access to the housing from various directions.

What is claimed is:

1. An apparatus for dispensing tennis ball containers, said apparatus comprising a housing, said housing supporting therein:

hopper means for storing tennis ball containers;

track means for conveying tennis ball containers, said track means having a first end disposed below said hopper means and adapted to receive tennis ball containers from said hopper means, said track means having a second end disposed below said first end and towards which said tennis ball containers may move and exit by force by gravity, and said track means comprising opposing, generally parallel first and second walls extending from said first end to said second end, wherein said first wall has a first slot and said second wall has a second slot; and dispensing means for releasing said tennis ball containers one at a time from said track means, said dispensing means disposed generally adjacent to said second end of said track means, and said dispensing means further comprising:

a first shaft mounted in said housing;

a generally U-shaped discharge lever, said discharge lever inverted and the opposite ends thereof rotatably connected to said first shaft, said discharge lever further including a discharge plate attached between said opposite ends and extending laterally from said discharge lever, said discharge lever rotatable between first and second positions to extend or retract said discharge plate through said first slot into and out of the path of said tennis ball containers, respectively;

a generally U-shaped stop lever, said stop lever inverted and the opposite ends thereof rotatably connected to said first shaft, said stop lever further including a stop plate attached between said opposite ends and extending laterally from said stop lever, said stop lever rotatable between first and second positions to retract or extend said stop plate through said second slot out of and into the path of said tennis ball containers, respectively;

means for swinging said discharge lever and said stop lever through a cycle in timed relation to alternately interrupt the movement of said tennis ball containers in said track means and dispense one or more tennis ball containers, such that during said cycle said stop lever moves from its first position allowing free movement of said tennis ball containers to its second position to interrupt the movement of one or more tennis ball containers to be retained in said track means, while said discharge lever retracts from its first position interrupting the movement of one or more tennis ball containers to be dispensed, to its second position allowing one or more tennis ball containers to be dispensed, after which said discharge lever returns to its first position to interrupt the movement of the next one or more tennis ball containers to be dispensed, and said stop lever returns to its first position allowing said tennis ball containers to freely move in said track means.

2. The apparatus for dispensing tennis ball containers of claim 1 wherein said means for swinging said discharge lever and said stop lever through a cycle in timed relation to alternately interrupt the movement of said tennis ball containers in said track means to dispense one or more tennis ball containers comprises:

first and second eccentric stub shafts rotatably mounted in said housing about an axis of rotation, at least one of said first and second eccentric stub shafts including an end face;

drive means for rotating said first and second eccentric stub shafts attached to at least one of said eccentric stub shafts;

a second shaft disposed in said housing and attached to said first and second eccentric stub shafts so that the central axis of said second shaft is offset from said axis of rotation, whereby said second shaft is eccentrically rotated;

at least one first lever arm extending from said discharge lever to at least one of said first and second eccentric stub shafts, each of said at least one first lever arms having a means for rotatably connecting to said end face of said at least one eccentric stub shaft, said at least one first lever arm rotatably connected thereto at a point off-set from said axis of rotation, whereby rotation of said first and second eccentric stub shafts swings said discharge lever between its first and second positions;

at least one second lever arm extending from said stop lever to said second shaft, each of said at least one second lever arms rotatably connected to said second shaft, whereby eccentric rotation of said second shaft swings said stop lever between its first and second positions; and means for actuating said drive means to rotate said first and second eccentric stub shafts through one revolution and swing said discharge lever and said stop lever through one cycle.

3. The apparatus for dispensing tennis ball containers of claim 2 wherein said drive means for rotating said first and second eccentric stub shafts comprises an electric motor mounted in said housing and adapted to provide a source of rotary power, a pulley disposed on said second shaft, and a drive belt connecting said source of rotary power to said pulley.

4. The apparatus for dispensing tennis ball containers of claim 1 wherein said means for swinging said discharge lever and said stop lever through a cycle in timed relation to alternately interrupt the movement of said tennis ball containers in said track means to dispense one or more tennis ball containers comprises:

first and second eccentric stub shafts rotatably mounted in said housing about an axis of rotation;

drive means for rotating said first and second eccentric stub shafts attached to at least one of said first and second eccentric stub shafts;

a second shaft disposed in said housing and attached to said first and second eccentric stub shafts so that said shaft is eccentrically rotated;

at least one first lever arm extending from said discharge lever to at least one of said first and second eccentric stub shafts, each of said at least one first lever arms attached eccentrically to said at least one eccentric stub shaft, whereby rotation of said first and second eccentric stub shafts swings said discharge lever between its first and second positions;

at least one second lever arm extending from said stop lever to said second shaft, said second lever arms attached to said second shaft, whereby rotation of said second shaft swings said stop lever between its first and second positions; and means for actuating said drive means to rotate said second shaft through one revolution and swing said discharge lever and said stop lever through one cycle.

5. The apparatus for dispensing tennis ball containers of claim 1 wherein said track means has a generally serpentine shape, extending downward and rearward from said first end at approximately 10 degrees from horizontal, turning approximately 40 degrees, and then extending downward and forwards towards said second end at approximately 30 degrees from horizontal.

6. The apparatus for dispensing tennis ball containers of claim 1 further comprising:

a dispensing bin disposed at said second end of said track means, said dispensing bin adapted to receive ones of said tennis ball containers dispensed from said track means; and a gate means disposed adjacent said dispensing bin for closing said second end of said track means when ones of said tennis ball containers are dispensed into said dispensing bin, said gate means including:

a consumer access door rotatably mounted to swing along one edge thereof in said housing;

a bin gate rotatably mounted to swing along one edge thereof in said housing;

at least one link arm inter-connecting said consumer access door and said bin gate, said at least one link arm connected to at least one edge of said bin gate and to at least one edge of said consumer access door; and at least one bias spring connecting said at least one link arm to said housing;

whereby said consumer access door is biased to a closed position blocking access to said dispensing bin while said bin gate is biased to an open position allowing substantially free movement of said tennis ball containers into said dispensing bin, and whereby raising said consumer access door inward to facilitate access to remove a tennis ball container dispensed into said dispensing bin, causes said bin gate to lower to a closed position blocking access to said second end of said track means.

7. The apparatus for dispensing tennis ball containers of claim 6 wherein said housing includes a removable housing panel substantially comprising the front housing panel of said housing, said removable housing panel further adapted to support said dispensing bin and said gate means.

8. The apparatus for dispensing tennis ball containers of claim 1 wherein said means for actuating said drive means comprises a control circuit mounted in said housing, said control circuit adapted to receive money and generate a control signal in response thereto.

9. The apparatus for dispensing tennis ball containers of claim 1 wherein said hopper means has a depth equal to the diameter of approximately six tennis ball containers and a height of approximately five tennis ball containers.

10. The apparatus for dispensing tennis ball containers of claim 1 wherein said hopper means is generally rectangular in shape and includes a front panel having a first aperture, a rear panel, two side panels, and a bottom panel having a second aperture mating with said first end of said track means;

wherein said bottom panel is inclined from horizontal to urge tennis ball containers placed in said hopper means to move towards said second aperture; and wherein said first aperture in said front panel is adapted to facilitate restocking said hopper means, said first aperture having a width less than the length of a tennis ball container, and a height sufficient to permit manipulation of a tennis ball container therethrough; and said housing further includes a removable front housing panel secured to said housing proximate to provide access to said first aperture.

11. The apparatus for dispensing tennis ball containers of claim 1 further comprising a stand upon which said housing is mounted.

12. An apparatus for dispensing tennis ball containers, said apparatus comprising a housing, said housing supporting therein:

hopper means for storing tennis ball containers wherein said hopper means includes a front panel, a rear panel, two side panels, and a bottom panel, at least one of said front, rear and side panels having a first aperture to permit restocking of tennis ball containers in said hopper; and wherein said bottom panel has a second aperture and is inclined from horizontal to urge tennis ball containers placed in said hopper means to move towards said second aperture;

track means for conveying tennis ball containers, said track means having a first end disposed below said hopper means mating with said second aperture and adapted to receive tennis ball containers from said hopper means, said track means having a second end disposed below said first end and towards which said tennis ball containers may move and exit by force of gravity; said track means comprising opposing, generally parallel first and second walls extending from said first end to said second wall has a second slot; and said track means further having a generally serpentine shape, extending downward and rearward from said first end at approximately 10 degrees from horizontal, turning approximately 40 degrees, and then extending downward and forwards towards said second end at approximately 30 degrees from horizontal;

dispensing means for releasing said tennis ball containers one at a time from said track means, said dispensing means disposed generally adjacent to said second end of said track means, and said dispensing means further comprising:

a first shaft mounted in said housing;

a generally U-shaped discharge lever, said discharge lever inverted and the opposite ends thereof rotatably connected to said first shaft, said discharge lever further including a discharge plate attached between said opposite ends and extending laterally from said discharge lever, said discharge lever rotatable between first and second positions toe extend or retract said discharge plate through said first slot into and out of the path of said tennis ball containers, respectively;

a generally U-shaped stop lever, said stop lever inverted and the opposite ends thereof rotatably connected to said first shaft, said stop lever further including a stop plate attached between said opposite ends and extending laterally from said stop lever, said stop lever rotatable between first and second positions to retract or extend said stop plate through said second slot out of and into the path of said tennis ball containers, respectively;

means for swinging said discharge lever and said stop lever through a cycle in timed relation to alternately interrupt the movement of said tennis ball containers in said track means and dispense one or more tennis ball containers, said means for reciprocating including:

first and second eccentric stub shafts rotatably mounted in said housing for rotation about an axis of rotation, at least one of said first and second eccentric stub shafts including an end face;

drive means for rotating said first and second eccentric stub shafts attached to at least one of said first and second eccentric stub shafts;

a second shaft disposed in said housing and attached to said first and second eccentric stub shafts, said second shaft having a central axis which is offset from said axis of rotation, whereby said second shaft is eccentrically rotated;

at least one first lever arm extending from said discharge lever to at least one of said first and second eccentric stub shafts, each of said at least one first lever arms having a means for rotatably connecting to said end face of said at least one eccentric stub shaft, said at least one first lever arm rotatably connected thereto at a point off-set from said axis of rotation, whereby rotation of said first and second eccentric stub shafts swings said discharge lever between its first and second positions;

at least one second lever arm extending from said stop lever to said second shaft, each of said at least one second lever arms rotatably connected to said second shaft, whereby eccentric rotation of said second shaft swings said stop lever between its first and second positions; and means for actuating said drive means to rotate said first and second eccentric stub shafts through one revolution and swing said discharge lever and said stop lever through one cycle;

a dispensing bin disposed at said second end of said track means, said dispensing bin adapted to receive ones of said tennis ball containers dispensed from said track means; and a gate means disposed adjacent said dispensing bin for closing said second end of said track means when ones of said tennis ball containers are dispensed into said dispensing bin, said gate means including:

a consumer access door rotatably mounted to swing along one edge thereof in said housing;

a bin gate rotatably mounted to swing along one edge thereof in said housing;

at least one link arm inter-connecting said consumer access door and said bin gate, said at least one link arm connected to at least one edge of said bin gate and to at least one edge of said consumer access door; and at least one bias spring connecting said at least one link arm to said housing;

whereby said stop lever moves from its first position allowing free movement of said tennis ball containers to its second position to interrupt the movement of one or more tennis ball containers to be retained in said track means, while said discharge lever retracts from its first position interrupting the movement of one or more tennis ball containers to be dispensed, to its second position allowing one or more tennis ball container to be dispensed, after which said discharge lever returns to its first position to interrupt the movement of the next one or more tennis ball containers to be dispensed, and said stop lever returns to its first position allowing said tennis ball containers to freely move in said track means, thereby dispensing one or more tennis ball containers into said dispensing bin; and whereby said consumer access door is biased to a closed position blocking access to said dispensing bin while said bin gate is biased to an open position allowing substantially free movement of said tennis ball containers into said dispensing bin, and raising said consumer access door inward to facilitate access to remove a tennis ball container dispensed into said dispensing bin, causes said bin gate to lower to a closed position blocking access to said second end of said track means;

whereby a tennis ball container is dispensed to a consumer.

* * * * *